US008327539B2

(12) United States Patent
Klein et al.

(10) Patent No.: US 8,327,539 B2
(45) Date of Patent: Dec. 11, 2012

(54) SYSTEM AND METHOD FOR FACILITATING PROPER ASSEMBLY OF AN EXHAUST SYSTEM

(75) Inventors: Patrick Klein, Madison, WI (US); Jeff Sedlacek, Stoughton, WI (US); David Grimm, Verona, WI (US)

(73) Assignee: Cummins Filtration IP, Inc, Minneapolis, MN (US)

( * ) Notice: Subject to any disclaimer, the term of this patent is extended or adjusted under 35 U.S.C. 154(b) by 1293 days.

(21) Appl. No.: 11/685,668

(22) Filed: Mar. 13, 2007

(65) Prior Publication Data

US 2007/0157468 A1 Jul. 12, 2007

Related U.S. Application Data

(63) Continuation-in-part of application No. 11/329,774, filed on Jan. 11, 2006, now Pat. No. 7,708,953.

(51) Int. Cl.
*B21D 51/16* (2006.01)

(52) U.S. Cl. ..... 29/890

(58) Field of Classification Search ..... 422/168, 422/177, 180

See application file for complete search history.

(56) References Cited

U.S. PATENT DOCUMENTS

| | | | | |
|---|---|---|---|---|
| 266,017 | A * | 10/1882 | Cooper | 285/402 |
| 5,016,438 | A | 5/1991 | Harris | |
| 5,176,406 | A | 1/1993 | Straghan | |
| 5,290,974 | A | 3/1994 | Douglas | |
| 5,849,250 | A | 12/1998 | Timko | |
| 6,578,851 | B1 | 6/2003 | Bryant, III | |
| 6,877,780 | B2 * | 4/2005 | Potts et al. | 285/420 |
| 2003/0039595 | A1 | 2/2003 | Geise | |
| 2003/0190269 | A1 | 10/2003 | Liu et al. | |
| 2004/0116276 | A1 | 6/2004 | Yezerets et al. | |
| 2005/0099001 | A1 | 5/2005 | Cassel et al. | |
| 2007/0039316 | A1 | 2/2007 | Bosanec, Jr. et al. | |

OTHER PUBLICATIONS

PCT/US2008/054949, International Search Report and Written Opinion, Jun. 3, 2009.

U.S. Appl. No. 11/329,774, Office Action, Jan. 30, 2009.

PCT/US2007/060413 International Search Report and Written Opinion mailed Jul. 22, 2008.

CN Application No. 200880007951.4 Office Action dated Feb. 22, 2012.

U.S. Appl. No. 11/329,774, Final Office Action mailed Sep. 15, 2009.

U.S. Appl. No. 11/329,774, Notice of Allowance mailed Dec. 14, 2009.

* cited by examiner

*Primary Examiner* — Tom Duong

(74) *Attorney, Agent, or Firm* — Kunzler Law Group, PC

(57) ABSTRACT

A system and method are disclosed for facilitating proper assembly of an exhaust system. The system includes a first modular exhaust treatment unit connectable to a second modular exhaust treatment unit. At one end, the first modular exhaust treatment unit includes a substantially continuous collar that integrates a first docking element therein. The second modular exhaust treatment unit includes a second docking element configured to engage the first docking element. When connected, the first and second docking elements operate to rotationally align and properly order the first and second modular exhaust treatment units.

20 Claims, 8 Drawing Sheets

SYSTEM AND METHOD FOR FACILITATING PROPER ASSEMBLY OF AN EXHAUST SYSTEM

RELATED APPLICATIONS

This application is a continuation-in-part of and claims priority to U.S. patent application Ser. No. 11/329,774, filed on Jan. 11, 2006 now U.S. Pat. No. 7,708,953 and entitled APPARATUS AND SYSTEM FOR ENSURING PROPER ASSEMBLY OF AN EXHAUST SYSTEM.

BACKGROUND OF THE INVENTION

1. Field of the Invention

This invention relates to exhaust treatment systems and more particularly relates to apparatus, systems, and methods for ensuring proper assembly of an exhaust system.

2. Description of the Related Art

Engine performance is becoming increasingly important under a growing demand for safe, reliable, and environmentally friendly transportation. Pursuant to achieving safe, reliable, and environmentally friendly transportation, is the implementation of effective exhaust treatment systems. Properly assembling exhaust treatment systems is a necessary component to providing effective exhaust treatment systems.

FIG. 1 is a perspective view of a prior art exhaust treatment system 100. The depicted system 100 includes an inflow subassembly 140, a first intermediate subassembly 130, a second intermediate subassembly 120, an outflow subassembly 110, and a set of subassembly fasteners 160. The system 100 also includes a pressure sensing member 150 for sensing the pressure in the inflow subassembly 110 and the second intermediate subassembly 130.

The performance of the exhaust treatment system 100 is dependent upon proper ordering (or sequencing) and rotational alignment of the various subassemblies 110, 120, 130, and 140. For example, in an embodiment where the first intermediate subassembly 130 is a catalytic converter and a second intermediate subassembly 120 is a filter, erroneously placing the filter 120 before the catalytic converter 130 would render the exhaust treatment system 100 useless from an emissions control standpoint. Also, as the pressure sensor 150 is substantially linear in shape and enters both the outflow subassembly 110 and the first intermediate subassembly 130 at openings that are similarly rotationally aligned. Accordingly, the outflow subassembly 110 and first intermediate subassembly 130 must be properly aligned for the pressure sensor to be able to properly enter the subassemblies 110, 130. In a scenario wherein the various subassemblies 110, 120, 130, and 140, are improperly ordered or aligned, the effectiveness of the exhaust treatment system 100 is forfeited.

SUMMARY OF THE INVENTION

The present invention has been developed in response to the present state of the art, and in particular, in response to the problems and needs in the art that have not yet been fully solved by currently available solutions. Accordingly, the present invention has been developed to provide an apparatus and system for ensuring proper assembly of an exhaust system that overcome many or all of the above-discussed shortcomings in the art.

In a first aspect of the invention, an apparatus for facilitating proper assembly of an exhaust system includes a first modular exhaust treatment unit connectable to a second modular exhaust treatment unit. In some embodiments, the first and second modular exhaust treatment units may include an inflow subassembly, a filter, a catalytic treatment unit, or an outflow subassembly. The first modular exhaust treatment unit may include a substantially continuous collar at an end thereof. A first docking element may be integrated into the substantially continuous collar at a predefined location. In certain embodiments, for example, the first docking element may include a recess, an indentation, a projection, a serration, or an aperture.

The second modular exhaust treatment unit may include a second docking element configured to engage the first docking element to rotationally align the first and second modular exhaust treatment units upon connection. In one embodiment, the second docking element is integrated into a second substantially continuous collar coupled to an end of the second modular exhaust treatment unit. The second docking element may include, for example, a recess, an indentation, a projection, a serration, or an aperture.

In certain embodiments, the first docking element may include a size, a shape, and/or a location uniquely corresponding to the second docking element. Further, in some embodiments, the system may include a gasket and/or a fastener to seal a connection between the first and second modular exhaust treatment units.

An alternative embodiment of a system for facilitating proper assembly of an exhaust system in accordance with the present invention may include first and second modular exhaust units, where the first modular exhaust unit includes a substantially cylindrical body having an annular ring coupled to an end thereof. In some embodiments, the annular ring may have a circumference substantially matching an end of the first modular exhaust treatment unit. The annular ring may further include a plurality of first docking elements integrated therewith such that each of the first docking elements has a predefined, unique location on the annular ring. Each of the first docking elements may include, for example, a recess, an indentation, a projection, a serration, or an aperture.

The second modular exhaust treatment unit may be connectable to the first modular exhaust treatment unit and may include a plurality of second docking elements configured to engage the plurality of first docking elements to rotationally align and properly order the first and second modular exhaust treatment units upon connection. Each of the second docking elements may include, for example, a recess, an indentation, a projection, a serration, or an aperture. In certain embodiments, each of the first docking elements may include a size or shape uniquely corresponding to each of the second docking elements. A gasket and/or fastener may seal the connection between the first and second modular exhaust treatment units.

A method for facilitating proper assembly of an exhaust system is also presented. The method in the disclosed embodiments substantially includes the steps necessary to carry out the functions presented above with respect to the operation of the described system. The method may include providing a first modular exhaust treatment unit, forming a substantially continuous collar having a perimeter substantially matching an end of the first modular exhaust treatment unit, integrating a first docking element into the substantially continuous collar at a predefined location, and attaching the substantially continuous collar to the end of the first modular exhaust treatment unit.

The method may further include providing a second modular exhaust treatment unit connectable to the first modular exhaust treatment unit, wherein the second modular exhaust treatment unit includes a second docking element configured to engage the first docking element. Finally, the method may include connecting the first and second modular exhaust treatment units such that the first and second docking elements engage to rotationally align the first and second modular exhaust treatment units.

In certain embodiments, connecting the first and second modular exhaust treatment units such that the first and second docking elements engage properly orders the first and second modular exhaust treatment units. In one embodiment, the first modular exhaust treatment unit includes a substantially cylindrical body. According to one aspect of this embodiment, forming the substantially continuous collar includes forming a cylinder having a diameter substantially corresponding to a diameter of the end of the first modular exhaust treatment unit and integrating, along a length of the cylinder, a first docking element at a predefined location. In one embodiment, the method further comprises sealing a connection between the first and second modular exhaust treatment units.

The various embodiments of the present invention provide corresponding features and advantages. Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

As used herein, the term "substantially continuous collar" refers to a single, adjoining collar having no substantial interruptions along its length. In some embodiments, the substantially continuous collar may include features integrated therein, such as projections, indentations, apertures, recesses, or the like, as discussed in more detail with reference to FIGS. 7A-7C below.

Figure 1:
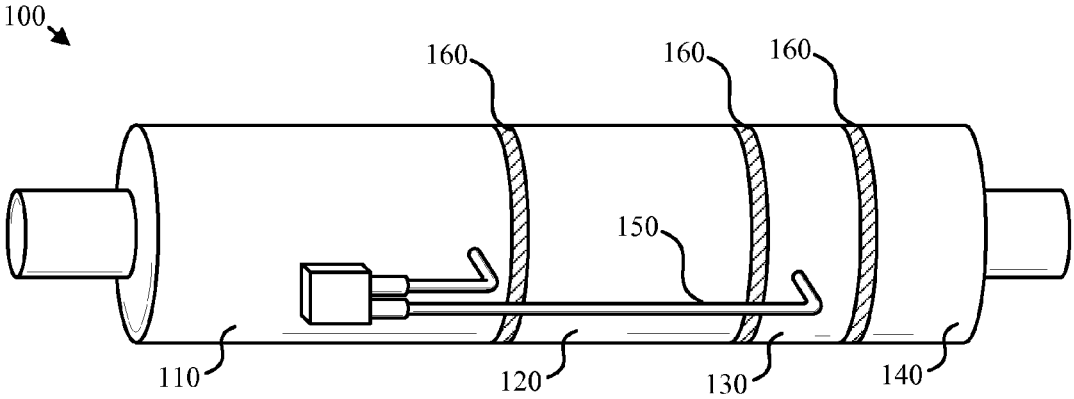
FIG. 1 is a perspective view of one embodiment of a prior art exhaust treatment system.
Figure 2:
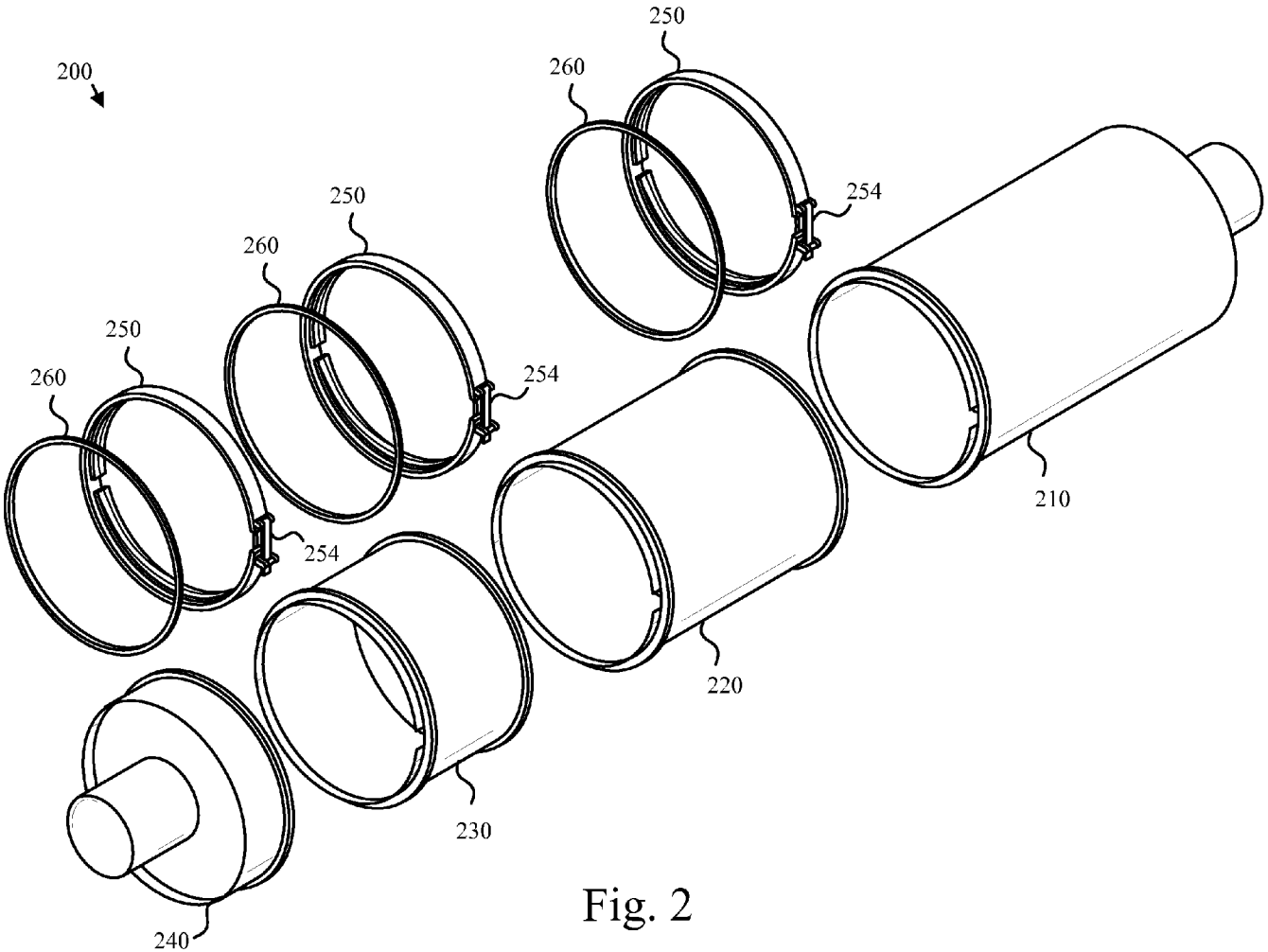
FIG. 2 is a perspective view of one embodiment of an exhaust treatment system in accordance with the present invention.

FIG. 2 is a perspective view of one embodiment of an exhaust treatment system 200 in accordance with the present invention. The depicted system 200 includes an inflow subassembly 240, a first intermediate subassembly 230, a second intermediate subassembly 220, an outflow subassembly 210, subassembly gaskets 260, and subassembly fasteners 250. In certain embodiments, the system 200 may also include a pressure sensing member similar to the pressure sensing member 150 of FIG. 1. The various components of the system 200 ensure proper assembly of the subassemblies 210, 220, 230, 240 according to a pre-selected subassembly order (or sequence) and rotational alignment. When fully assembled, in certain embodiments, the exhaust treatment system 200 appears substantially similar to the system of FIG. 1.

The inflow subassembly 240 receives engine exhaust. The first intermediate subassembly selectively mates and rotationally aligns with the inflow subassembly 240 and receives exhaust therefrom. Similarly, the second intermediate subassembly 220 selectively mates and rotationally aligns with the first intermediate subassembly 230 and receives exhaust therefrom. Also, the outflow subassembly 210 selectively mates with the second intermediate subassembly 220 according to a pre-selected alignment and receives exhaust therefrom.

Figure 3:
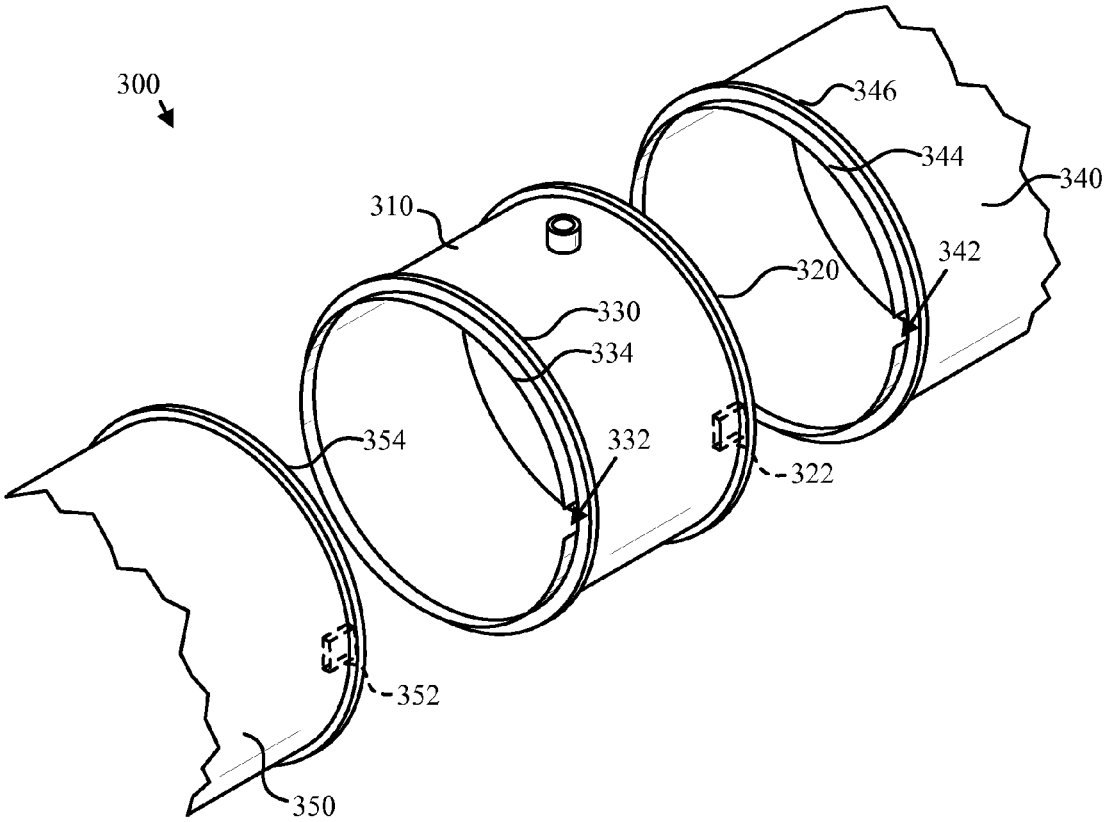
FIG. 3 is a perspective view of one embodiment of an exhaust treatment subassembly in accordance with the present invention.
Figure 4:
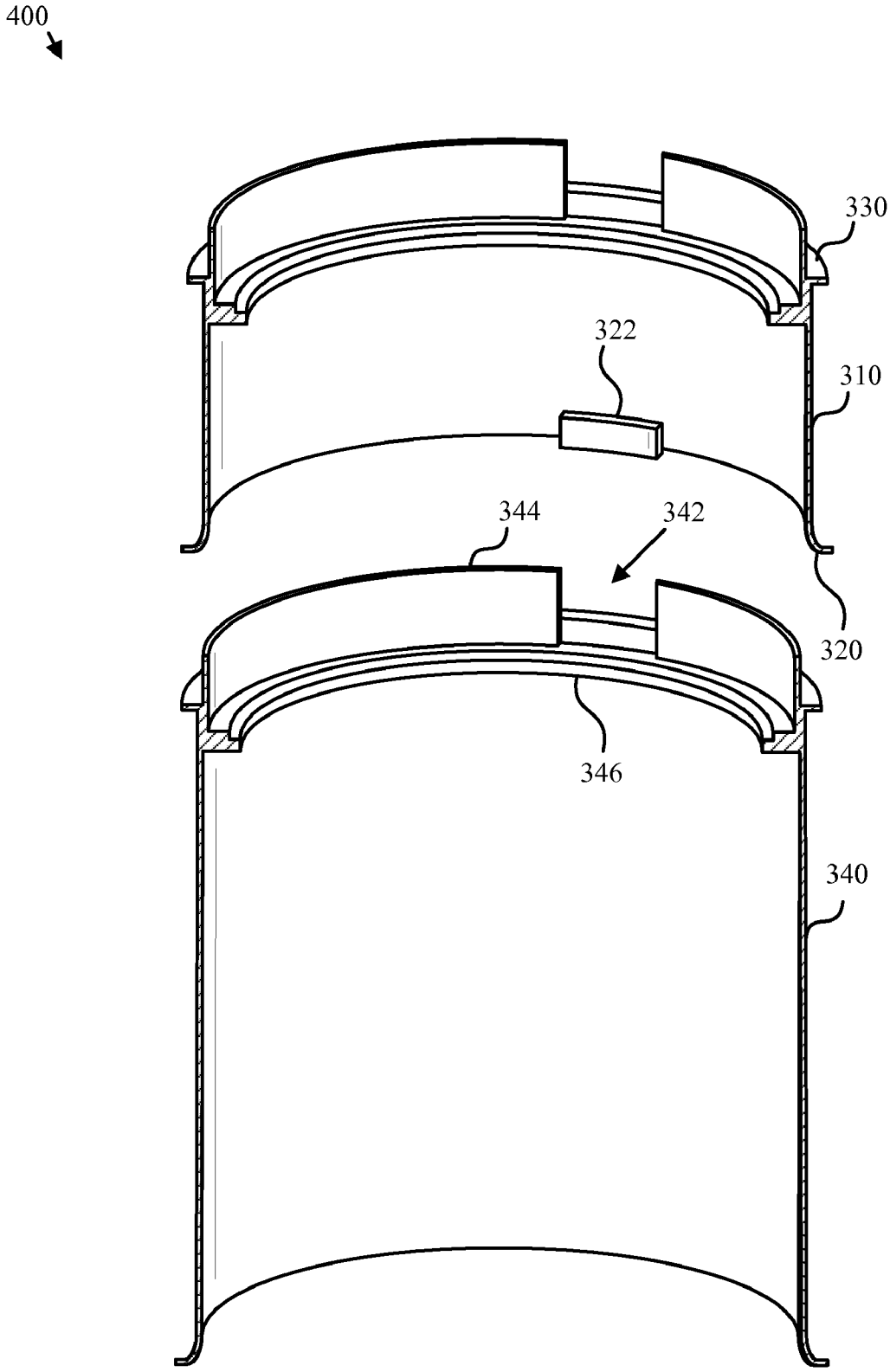
FIG. 4 is a cross sectional view of one embodiment of an exhaust treatment subassembly in accordance with the present invention.
Figure 5:
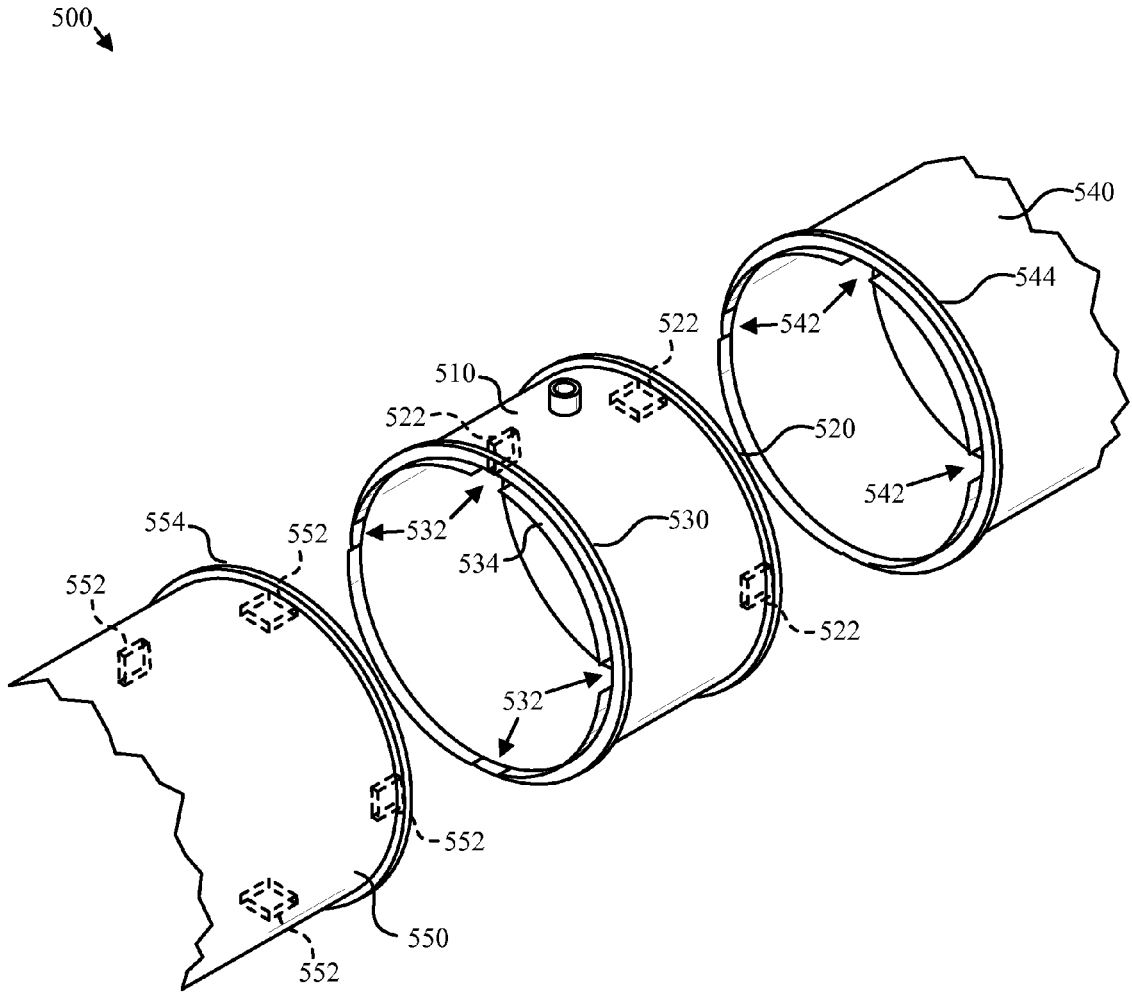
FIG. 5 is a perspective view of one embodiment of an exhaust treatment subassembly in accordance with the present invention.

As further taught in FIGS. 3, 4, and 5, in certain embodiments, the subassemblies 210, 220, 230, and 240 ensure proper assembly via a docking element (such as a projection or recess) sized, shaped, and positioned to mate with a docking element (such as a corresponding recess or projection) of a specific, adjacent subassembly. Before the subassemblies 210, 220, 230, 240 are mated, a gasket 260 may be positioned at the mating point of each subassembly 210, 220, 230, 240 so as to ensure no gaseous leakage will occur. Once the subassemblies 210, 220, 230, 240 are mated and the gasket 260 is in place, a fastener 250 or similar device may be place over each gasket and fasten the mating of each subassembly 210, 220, 230, 240 (see FIG. 1). In the depicted embodiment, each fastener 250 includes a clamping member 254 that tightens the fastener 250 over the perimeter of adjoining subassemblies.

FIG. 3 is a perspective view of one embodiment of an exhaust treatment subassembly 300 in accordance with the present invention. The depicted subassembly 300 includes an exhaust treatment unit 310, a first mating perimeter 320, a projection 322, a second mating perimeter 330, a recess 332, and a recess rim 334. The various components of the exhaust treatment subassembly 300 ensure proper assembly by requiring selective mating according to a pre-selected subassembly order and rotational alignment with adjacent subassemblies 340, 350.

When mated, the exhaust treatment unit 310 receives exhaust from an upstream unit 340 and provides exhaust to a downstream unit 350. The exhaust treatment unit 310 may include a variety of exhaust treatment subassemblies such as a catalytic converter or a filter. Accordingly, a particular emissions functionality of the exhaust treatment unit 310 is not a necessary aspect of the present invention.

The first mating perimeter 320 selectively mates with an upstream mating perimeter 346 of the upstream exhaust treatment subassembly 340. In the depicted embodiment, the first mating perimeter 320 includes a docking element in the form of a projection 322 and the upstream mating perimeter 346 includes a docking element in the form of an upstream recess 342 and upstream recess rim 344. The upstream recess 342 is specifically sized, shaped, and placed to receive the projection 322 of the exhaust treatment unit 310 as opposed to the projection 352 of the downstream exhaust treatment unit 350.

Similarly, the second mating perimeter 330 of the exhaust treatment unit 310 mates with a downstream mating perimeter 354 of the downstream exhaust treatment unit 350. The depicted second mating perimeter 330 includes docking element in the form of a recess 332 and a recess rim 334. The recess 332 is specifically sized to receive the down stream projection 352, similar to the projection 322 and upstream recess 342. Accordingly, the size of the projections 322, 352 and recesses 332, 342 function to ensure selective mating and rotational alignment of the subassemblies 310, 340, 350. In an embodiment involving multiple subassemblies, each subassembly may implement a similar strategy to ensure proper assembly of each subassembly in the entire exhaust treatment system 200 (see FIG. 2).

As the mating between the first mating perimeter 320 and upstream mating perimeter 346 and mating between the second mating perimeter 330 and the downstream mating perimeter 354 are substantially similar in the depicted embodiment, the following will disclose, teach, and enable the mating between the first mating perimeter 320 and upstream mating perimeter 346 and thereby inferentially disclose, teach, and enable the mating between the second mating perimeter 330 and the downstream mating perimeter 354.

Accordingly, once the projection 322 is received by the upstream recess 342, the upstream recess rim 344 impedes rotation of the two exhaust treatment units 310, 340 as the received projection 322 is in contact with the upstream rim 344. Accordingly, the specifically sized, shaped, and placed projection 322 and corresponding upstream recess 342 ensure proper mating and rotational alignment, as another subassembly with an overly large projection will not fit into the upstream recess 342 and another subassembly with a projection that is too small will allow a slight rotation of the subassemblies indicating an improper order or sequencing of subassemblies.

In certain embodiments, the shape of the projection 322 and corresponding upstream recess 342 may be substantially triangular, octagonal, etc, as opposed to substantially rectangular as depicted. Accordingly, the size, shape, and placement of the docking elements (i.e. projection 322 and recess 342) need not be specific, so long as the size, shape, and placement ensure selective subassembly mating and rotational alignment.

FIG. 4 is a cross-sectional view of one embodiment of an exhaust treatment subassembly 400 in accordance with the present invention. The depicted subassembly 400 includes an exhaust treatment unit 310 with a first mating perimeter 320 and a second mating perimeter 330. The cross sectional view of the subassembly shown in FIG. 3 is presented to highlight particular details of one embodiment of the present invention.

Accordingly, the projection 322 is received by a specifically sized, shaped, and positioned, upstream recess 342. The recess 342 is a space created by an upstream recess rim 344 that rotationally aligns and selectively mates the exhaust treatment units 310, 340, as only the projection 322 may properly fit into the upstream recess 342 as opposed to the projection of another exhaust treatment unit (see FIG. 2).

In the depicted embodiment, the both the projection 322 and the recess 342 are substantially rectangular in shape and complementary in size. Selective mating, proper ordering or sequencing is achieved as only the projection 322 will properly fit into the recess 342. All other projections will have a different size, shape, or position. Rotational alignment is achieved as the first mating perimeter 320 and the upstream mating perimeter 346 can only mate if the projection 322 is fitted within the recess 342. Accordingly, the present invention ensures proper assembly of an exhaust system by requiring selective mating and rotational alignment of the subassemblies within the system.

FIG. 5 is a perspective view of one embodiment of an exhaust treatment subassembly 500 in accordance with the present invention. Contrasting the subassembly illustrated in FIGS. 3 and 4, the depicted subassembly 500 teaches an embodiment with a plurality of projections 522 and recess 552. Accordingly, the illustrated embodiment is only one of many possible embodiments that ensure proper assembly of exhaust treatment subassemblies via selective mating and rotational aligning.

Similar to the subassembly of FIG. 3, the first mating perimeter 520 of the exhaust treatment unit 510 mates with a mating perimeter 544 of an upstream unit 540. Also, the second mating perimeter 530 of the exhaust treatment unit 510 mates with the mating perimeter 554 of a downstream unit 550. However, unlike the subassembly of FIG. 3, the depicted subassembly 500 illustrates first and second docking element in the form of a first set of projections 522 and second set of recesses 532, respectively.

The three projections 522 of the exhaust treatment unit 510 particularly correspond in size, shape, placement, and number to the three upstream recesses 542 of the upstream exhaust treatment unit 540. Similarly, the four recesses 532 of the exhaust treatment unit 510 particularly correspond in size, shape, placement, and number to the four downstream projections 552 of the down stream exhaust treatment unit 550. Accordingly, during assembly, the downstream exhaust treatment unit 550 cannot be erroneously ordered or sequenced next to the upstream exhaust treatment unit 540 as the downstream exhaust treatment unit 550 requires four recesses but the upstream exhaust treatment unit 540 only provides three recesses 542.

In certain embodiments, the number and size of projections 522, 552 may vary. In other embodiments, the exhaust treatment unit 510 provides docking elements of different styles. For example, one docking element may include a set of projections 522 that correspond to upstream recesses 542 on one side of the exhaust treatment unit 510 (as depicted), and the other docking element may include a serrated edge that corresponds the serrated edge of a downstream exhaust treatment unit (not shown). Accordingly, an exhaust treatment unit having docking elements of different styles may adequately accomplish the task of ensuring proper assembly of the exhaust treatment system via selective mating and mandatory rotational alignment. In other words, the docking elements need not be type or style specific to accomplish the general task of ensuring proper assembly of exhaust treatment systems.

Figure 6:
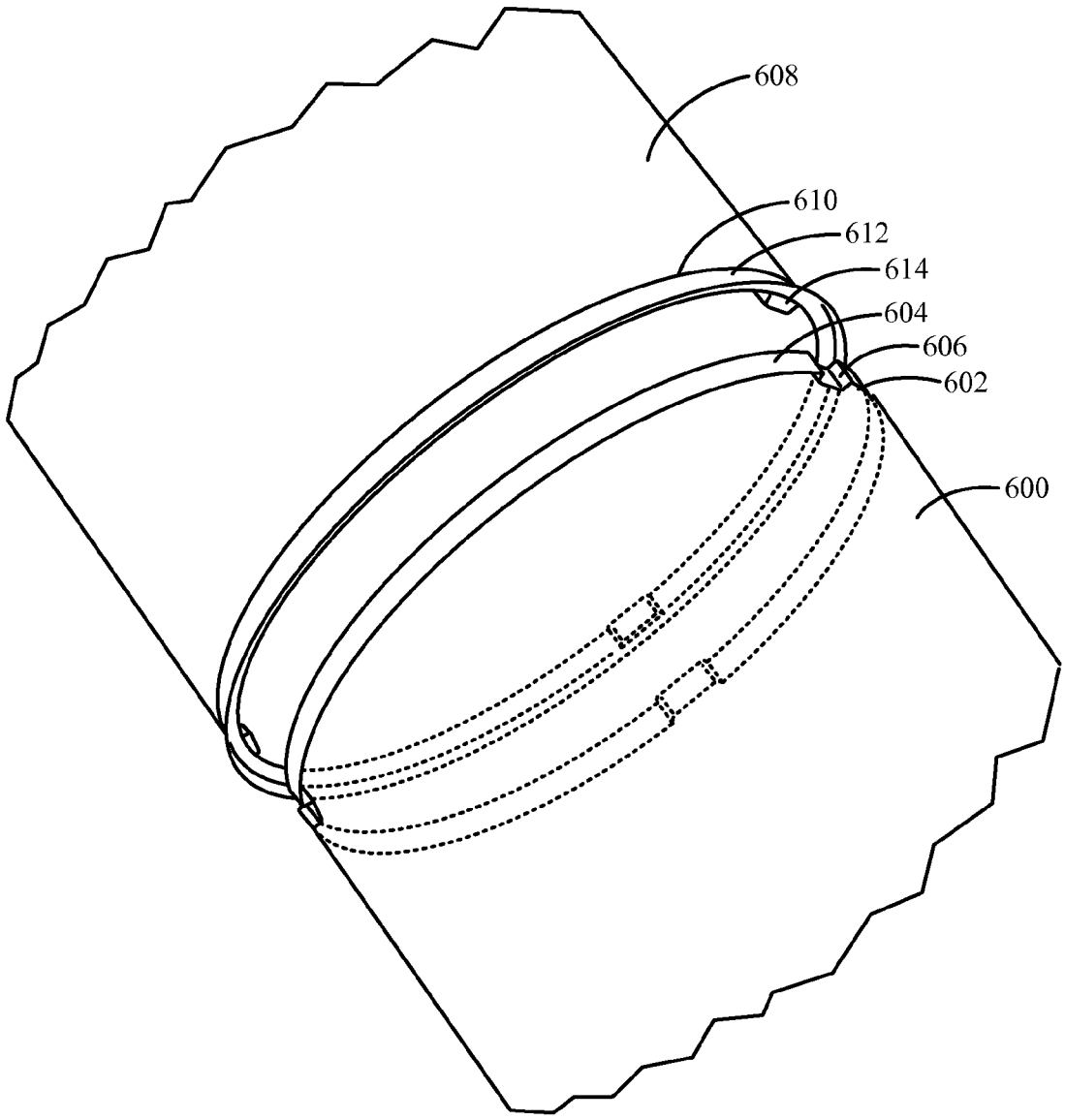
FIG. 6 is a perspective view of first and second modular exhaust treatment units in accordance with certain embodiments of the present invention.

Referring now to FIG. 6, embodiments of the present invention may include multiple modular exhaust treatment units 600 that may be selectively connected to each other. As previously discussed, a modular exhaust treatment unit 600 may comprise, for example, an inflow subassembly, a filter, a catalytic converter, an outflow subassembly, or the like. In some embodiments, a first modular exhaust treatment unit 600 may include an end 602 coupled to a substantially continuous collar 604. In other embodiments, the substantially continuous collar 604 and the first modular exhaust treatment unit 600 may be a monolithic unit, where the substantially continuous collar 604 extends from an end 602 of first modular exhaust treatment unit 600.

The substantially continuous collar 604 may be circular, square, oblong, triangular, or may comprise any other shape known to those in the art. In any case, however, the substantially continuous collar 604 forms an entirely enclosed space having no discernable beginning or end, although it may include one or more seams joined by a weld, an adhesive or other adjoining feature. In this manner, the substantially continuous collar 604 facilitates ease of manufacture and assembly by minimizing component parts and steps necessary for implementation and use.

A first docking element 606 may be integrated into the substantially continuous collar 604 to facilitate rotational alignment and/or proper ordering of the first and second modular exhaust treatment units 600, 608. Specifically, the first docking element 606 may be uniquely compatible with a second docking element 614 integrated into a second modular exhaust treatment unit 608. In one embodiment, the second docking element 614 is integrated into a second substantially continuous collar 612 coupled to an end 610 of the second modular exhaust treatment unit 608. The first and second docking elements 606, 614 may be configured to rotationally align the first and second modular exhaust treatment units 600, 608 upon connection. Further, in some embodiments, the first and second docking elements 606, 614 may function to ensure that the first and second modular exhaust treatment units 600, 608 are properly ordered.

To this end, each of the first and second docking elements 606, 614 may comprise a size, shape, and/or location that is uniquely compatible with the other. In one embodiment, for example, the first docking element 606 may comprise an indentation uniquely sized and located to accommodate a second docking element 614 comprising a similarly sized and located projection. In other embodiments, the first docking element 606 may comprise, for example, a projection, a recess, a serration, an aperture, or the like. Likewise, the second docking element 614 may comprise a projection, a recess, a serration, an aperture, or the like, having a size, shape and/or location that is uniquely compatible with the first docking element 606. During operation, the first and second docking elements 606, 614 may engage each other to rotationally align and, in some cases, properly order the first and second modular exhaust treatment units 600, 608 upon connection.

Figure 7A:
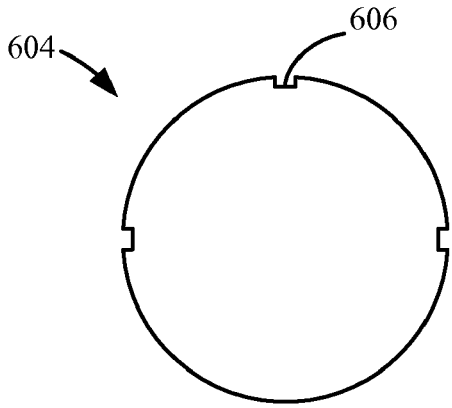
FIGS. 7A-7C are top views of alternative embodiments of first docking elements integrated into a substantially continuous collar in accordance with the present invention.
Figure 7B:
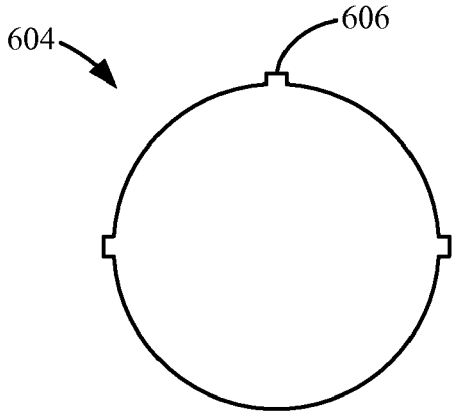
Figure 7C:
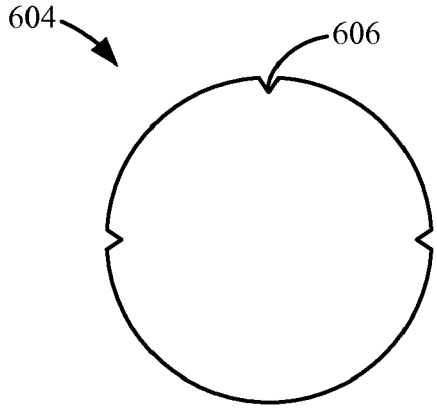

Referring now to FIGS. 7A-7C, a substantially continuous collar 604 in accordance with certain embodiments of the present invention enables a first docking element 606 to be quickly and easily integrated therein at multiple unique locations, thus simplifying a manufacturing process for creating a variety of unique collars 604. Indeed, this feature of the present invention enables quick and easy manufacture of a collar 604 or of a monolithic modular exhaust treatment unit 600 having a collar 604 customized for use with a particular engine platform, while minimizing a risk that components intended for use with one engine platform could be used with another.

As shown in FIGS. 7A-7C, a substantially continuous collar 604 may include a plurality of first docking elements 606 having predetermined locations along its perimeter. Each of the plurality of first docking elements may be integrated into the substantially continuous collar 604 by stamping, molding, deforming, bending, or otherwise shaping a portion of the substantially continuous collar 604 at a predefined location.

Each docking element 606 may be integrated in either an inward or outward direction with respect to the substantially continuous collar 604. Where a first docking element 606 is integrated in an inward direction with respect to the substantially continuous collar 604, a second docking element 614 having a substantially corresponding location may be integrated in an outward direction with respect to a second substantially continuous collar 612 coupled to or continuous with an end 610 of the second modular exhaust treatment unit 608. In this manner, the first and second docking elements 606, 614 may engage each other to rotationally align the first and second modular exhaust treatment units 600, 608 upon connection.

In one embodiment, as shown in FIG. 7A, the first docking element 606 may comprise a recess configured to accommodate a similarly sized, shaped, and located projection. In another embodiment, as shown in FIG. 7B, the first docking element 606 may comprise a projection integrated to project outwardly from the substantially continuous collar 604 and configured to engage a corresponding recess. In yet another embodiment, as shown in FIG. 7C, the first docking element 606 may comprise a projection integrated to project inwardly from the substantially continuous collar 604. In other embodiments, a substantially continuous collar 604 may comprise first docking elements 606 having a combination of sizes, shapes, locations, and/or directional orientations.

Figure 8:
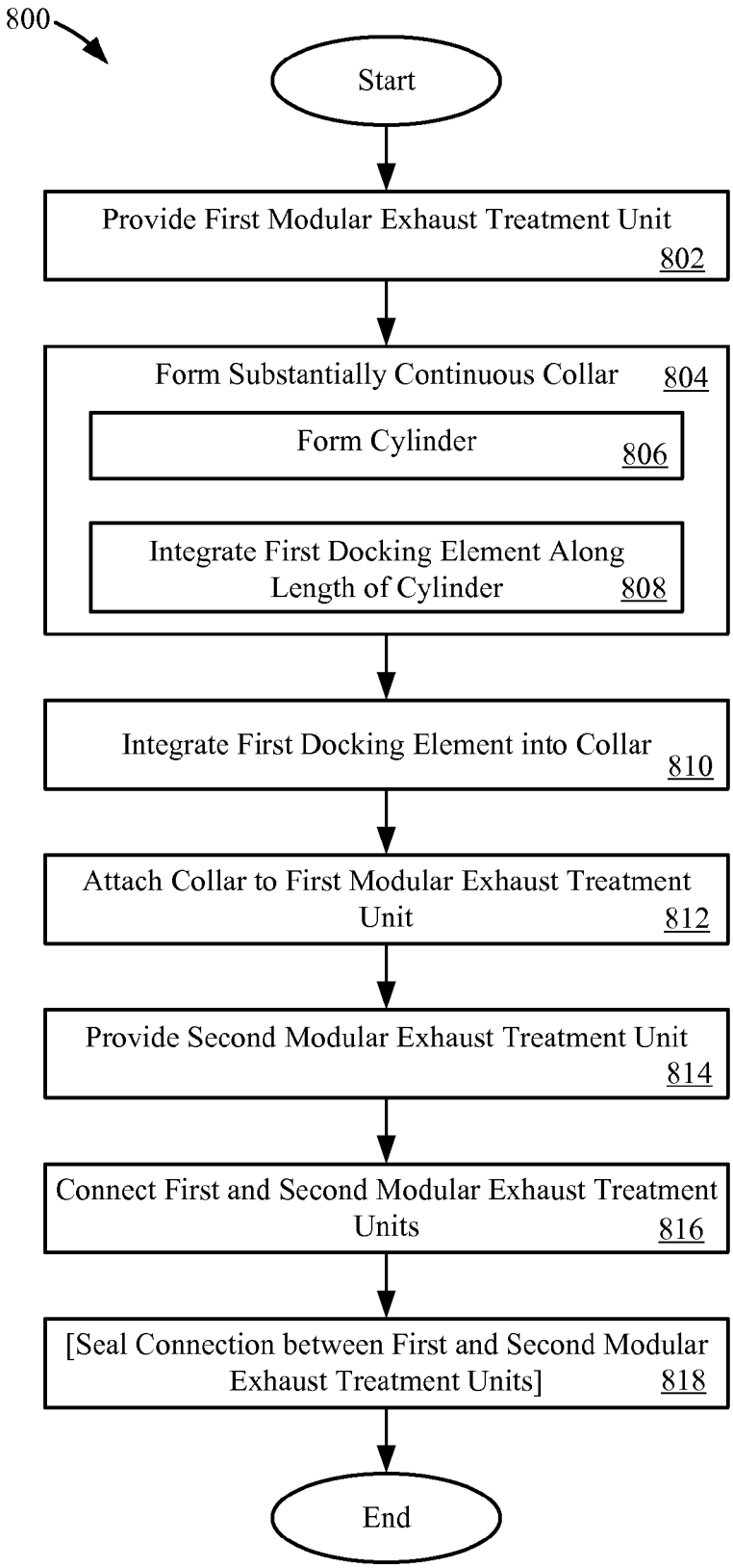
FIG. 8 is a flow chart of steps for facilitating proper assembly of an exhaust system in accordance with certain embodiments of the present invention.

Referring now to FIG. 8, a method 800 for facilitating proper assembly of an exhaust system may include providing 802 a first modular exhaust treatment unit, forming 804 a substantially continuous collar, integrating 810 a first docking element into the collar, and attaching 812 the substantially continuous collar to the first modular exhaust treatment unit. Alternatively, the substantially continuous collar and first modular exhaust treatment unit may form a monolithic unit.

The substantially continuous collar may have a perimeter substantially matching an end of the first modular exhaust treatment unit. For example, where the first modular exhaust treatment unit is substantially cylindrical in shape, the substantially continuous collar may be created by forming 806 a cylinder having a circumference substantially corresponding to a circumference of the first modular exhaust treatment unit and integrating 808, along a length of the cylinder, a first docking element at a predefined location. Integrating 808 a first docking element may comprise stamping, molding, deforming, bending, or otherwise shaping a portion of the cylinder at a predefined location.

The method may further include providing 814 a second modular exhaust treatment unit, where the second modular exhaust treatment unit is connectable to the first modular exhaust treatment unit. The second modular exhaust treatment unit may further comprise a second docking element configured to engage the first docking element. The method may next include connecting 816 the first and second modular exhaust treatment units such that the first and second docking elements engage to rotationally align and, in some instances, properly order the first and second modular exhaust treatment units. In one embodiment, the method further comprises sealing 818 the connection between the first and second modular exhaust treatment units with, for example, a gasket and/or fastener.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for facilitating proper assembly of an exhaust system, the method comprising:

providing a first modular exhaust treatment unit;

forming a first substantially continuous collar separate from the first modular exhaust treatment unit, the first substantially continuous collar having a perimeter substantially matching an end of the first modular exhaust treatment unit;

integrating a first docking element into the first substantially continuous collar at a first predefined location, wherein the first docking element is positioned about only a portion of the first continuous annular collar, and wherein the first continuous annular collar extends axially from a first end to a second end, the first docking element extending from the first end to the second end of the first continuous annular collar;

attaching the first substantially continuous collar to the end of the first modular exhaust treatment unit;

providing a second modular exhaust treatment unit connectable to the first modular exhaust treatment unit;

forming a second substantially continuous collar separate from the second modular exhaust treatment unit, the second substantially continuous collar having a perimeter substantially matching an end of the second modular exhaust treatment unit;

integrating a second docking element into the second substantially continuous collar at a second predefined location corresponding to the first predefined location, the second docking element being configured to engage the first docking element, wherein the second docking element is positioned about only a portion of the second continuous annular collar, and wherein the second continuous annular collar extends axially from a first end to a second end, the second docking element extending from the first end to the second end of the second continuous annular collar;

attaching the second substantially continuous collar to the end of the second modular exhaust treatment unit; and connecting the ends of the first and second modular exhaust treatment units such that the first and second docking elements engage to rotationally align the first and second modular exhaust treatment units.

2. The method of claim 1, further comprising sealing a connection between the first and second modular exhaust treatment units.

3. The method of claim 1, wherein the first modular exhaust treatment unit comprises a substantially cylindrical body.

4. The method of claim 3, wherein forming the first and second substantially continuous collars comprises:

forming a first cylinder having a diameter substantially corresponding to a diameter of the end of the first modular exhaust treatment unit;

forming a second cylinder having a diameter substantially corresponding to a diameter of the end of the second modular exhaust treatment unit.

5. The method of claim 1, wherein integrating the first docking element into the first substantially continuous collar comprises forming an indentation in the first substantially continuous collar.

6. The method of claim 5, wherein integrating the second docking element into the second substantially continuous collar comprises forming an indentation in the second substantially continuous collar.

7. The method of claim 1, wherein the first docking element comprises at least one of a size and a shape uniquely corresponding to the second docking element.

8. A method for facilitating proper assembly of an exhaust system, the method comprising:

providing a first modular exhaust treatment unit;

forming a first substantially continuous collar separate from the first modular exhaust treatment unit, the first substantially continuous collar having a perimeter substantially matching an end of the first modular exhaust treatment unit;

integrating at least one first docking element into the first substantially continuous collar at a first predefined location, wherein the first docking element is positioned about only a portion of the first continuous annular collar, and wherein the first continuous annular collar extends lengthwise from a first end to a second end, the first docking element extending an entire length of the first continuous collar from the first end to the second end;

attaching the first substantially continuous collar to the end of the first modular exhaust treatment unit;

providing a second modular exhaust treatment unit connectable to the first modular exhaust treatment unit;

coupling at least one second docking element to the second modular exhaust treatment unit at a second predefined location corresponding to the first predefined location, the second docking element being configured to engage the first docking element; and connecting the ends of the first and second modular exhaust treatment units such that the first and second docking elements engage to rotationally align the first and second modular exhaust treatment units.

9. The method of claim 8, wherein attaching the first substantially continuous collar to the end of the first modular exhaust treatment unit comprises attaching one of the first and second ends of the annular collar to the end of the first modular exhaust treatment unit in an end-to-end configuration.

10. The method of claim 8, wherein attaching the first substantially continuous collar to the end of the first modular exhaust treatment unit comprises attaching the first substantially continuous collar to the end of the first modular exhaust treatment unit in a non-overlapping configuration.

11. The method of claim 8, further comprising forming a second substantially continuous collar separate from the second modular exhaust treatment unit and integrating the second docking element into the second substantially continuous collar at the second predefined location corresponding to the first predefined location, wherein the second docking element is positioned about only a portion of the second continuous annular collar, and wherein the second continuous annular collar extends lengthwise from a first end to a second end of the second continuous annular collar, the second docking element extending an entire length of the second continuous collar from the first end to the second end of the second continuous annular collar, and wherein coupling the second docking element to the second modular exhaust treatment unit comprises attaching the second substantially continuous collar to the end of the second modular exhaust treatment unit.

12. The method of claim 8, wherein each of the first and second modular exhaust treatment units are selected from the group consisting of an inflow subassembly, a filter, a catalytic treatment unit, and an outflow subassembly.

13. The method of claim 8, wherein the first docking element is selected from the group consisting of a recess, an indentation, a projection, a serration, and an aperture.

14. The method of claim 8, wherein the second docking element is selected from the group consisting of a recess, an indentation, a projection, a serration, and an aperture.

15. The method of claim 8, further comprising properly ordering the first modular exhaust treatment unit relative to the second modular exhaust treatment unit solely by engaging the first and second docking elements.

16. The method of claim 8, further comprising sealing the connection between the ends of the first and second modular exhaust treatment units with at least one of a gasket and a fastener.

17. The method of claim 8, wherein integrating at least one first docking element into the first substantially continuous collar at the first predefined location comprises integrating a plurality of first docking elements into the first substantially continuous collar at respective first predefined locations, and wherein coupling at least one second docking element to the second modular exhaust treatment unit at the second predefined location comprises coupling a plurality of second docking elements to the second modular exhaust treatment unit at respective second predefined locations each corresponding with a respective one of the first predefined locations.

18. A method for facilitating proper assembly of an exhaust system, the method comprising:

providing a first modular exhaust treatment unit;

forming a first continuous annular ring separate from the first modular exhaust treatment unit, the first continuous annular ring having a perimeter substantially matching an end of the first modular exhaust treatment unit;

integrating a plurality of first docking elements into the first continuous annular ring with each first docking element being in a first predefined, unique location on the annular ring, wherein the first docking elements are positioned about only a portion of the first continuous annular ring, and wherein the first continuous annular ring extends axially from a first end to a second end, the first docking elements extending from the first end to the second end of the first continuous annular ring;

attaching the first continuous annular ring to the end of the first modular exhaust treatment unit;

providing a second modular exhaust treatment unit connectable to the first modular exhaust treatment unit;

forming a second continuous annular ring separate from the second modular exhaust treatment unit, the second continuous annular ring having a perimeter substantially matching an end of the second modular exhaust treatment unit;

integrating a plurality of second docking elements into the second continuous annular ring with each second docking element being in a second predefined, unique location on the annular ring corresponding to the first predefined, unique location, the second docking elements each being configured to engage a respective one of the first docking elements, wherein the second docking elements are positioned about only a portion of the second continuous annular ring, and wherein the second continuous annular ring extends axially from a first end to a second end, the second docking elements extending from the first end to the second end of the second continuous annular ring;

attaching the second continuous annular ring to the end of the second modular exhaust treatment unit; and connecting the ends of the first and second modular exhaust treatment units such that the first and second docking elements engage each other to rotationally align the first and second modular exhaust treatment units.

19. The method of claim 18, wherein at least one of the plurality of first docking elements comprises at least one of a different shape and different size relative to the other of the plurality of first docking elements, wherein at least one of the plurality of second docking elements comprises at least one of a different shape and different size relative to the other of the plurality of second docking elements.

20. The method of claim 18, wherein each of the first and second modular exhaust treatment units are selected from the group consisting of an inflow subassembly, a filter, a catalytic treatment unit, and an outflow subassembly.

* * * * *